US006598375B2

(12) United States Patent
Connelly

(10) Patent No.: US 6,598,375 B2
(45) Date of Patent: Jul. 29, 2003

(54) LID APPLICATOR

(75) Inventor: Paul J. Connelly, Toronto (CA)

(73) Assignee: Longford Equipment International Limited, Scarborough (CA)

( * ) Notice: Subject to any disclaimer, the term of this patent is extended or adjusted under 35 U.S.C. 154(b) by 0 days.

(21) Appl. No.: 09/893,582

(22) Filed: Jun. 29, 2001

(65) Prior Publication Data

US 2003/0000178 A1 Jan. 2, 2003

(51) Int. Cl.[7] ..... B65B 7/28; B67B 1/03; B67B 3/04; B67B 5/00

(52) U.S. Cl. ..... 53/487; 53/485; 53/291; 53/294

(58) Field of Search ..... 53/291, 294, 290, 53/485, 487, 261, 580, 306, 488, 482, 491

(56) References Cited

U.S. PATENT DOCUMENTS

| | | | | | |
|---|---|---|---|---|---|
| 1,080,277 | A | | 12/1913 | Harbeck | |
| 1,831,883 | A | * | 11/1931 | Risser | 53/294 |
| 1,835,336 | A | * | 12/1931 | Risser | 53/294 |
| 3,634,995 | A | * | 1/1972 | Curtis | 53/306 |
| 4,117,646 | A | * | 10/1978 | James et al. | 53/580 |
| 4,171,603 | A | * | 10/1979 | Wiseman | 53/261 |
| 4,459,791 | A | | 7/1984 | Booth | |
| 4,570,420 | A | | 2/1986 | Raz | |
| 4,671,046 | A | * | 6/1987 | Lewis et al. | 53/306 |
| 4,745,728 | A | * | 5/1988 | Valenti | 53/306 |
| 5,184,996 | A | * | 2/1993 | Rode et al. | 53/580 |
| 5,369,939 | A | * | 12/1994 | Moen et al. | 53/306 |
| 5,457,933 | A | * | 10/1995 | LaVars et al. | 53/261 |
| 5,657,617 | A | * | 8/1997 | Allen et al. | 53/306 |
| 6,048,421 | A | * | 4/2000 | White | 53/306 |

OTHER PUBLICATIONS

A brochure "TL–4 High Speed Tray Labeling System" by Sinclair Systems International, LLC of California, U.S.A., published Apr. 29, 1999.

* cited by examiner

*Primary Examiner*—Anthony D. Stashick

(57) ABSTRACT

In order to fit a box lid to a box tray a pair of opposed plates are used. Each plate is pivotably mounted intermediately of its upper and lower edges such that upper edges of the opposed plates may pivot toward and away from each other. Each plate is biased to an inclined position whereat the upper edges of the opposed plates are more proximate than the lower edges of the plates. With this arrangement, a lid may be placed with respect to the pair of opposed plates such that opposed lower edges of the lid are positioned below the upper edges of said plates and at an outward side of said plates. A box tray may then be raised between the plates such that the box tray urges each of the plates away from its inclined position.

13 Claims, 7 Drawing Sheets

LID APPLICATOR

BACKGROUND OF THE INVENTION

This invention relates to a lid applicator and a method of applying a lid.

Typically, bank cheques are sent to account holders through the mails in boxes. To prepare cheques for mailing, bundles of cheques may be automatically dispensed into a box tray and then a box lid is manually fitted to the box tray. The manual fitting of the lids copes with the fact that the sides of the box trays and lids are often bowed or otherwise mis-shapen. However, this manual operation slows the speed of preparation for mailing. This invention therefore seeks to automate this operation.

SUMMARY OF INVENTION

In order to fit a flexible lid to a flexible container a pair of opposed plates are used. Each plate is pivotably mounted intermediately of its upper and lower edges such that upper edges of the opposed plates may pivot toward and away from each other. Each plate is biased to an inclined position whereat the upper edges of the opposed plates are more proximate than the lower edges of the plates. With this arrangement, a lid may be placed with respect to the pair of opposed plates such that opposed lower edges of the lid are positioned below the upper edges of said plates and at an outward side of said plates. A flexible container may then be raised between the plates such that the container urges each of the plates away from its inclined position.

According to one aspect of the invention, there is provided a box-lid applicator, comprising: a pair of opposed plates, each plate pivotably mounted intermediately of its upper and lower edges such that upper edges of said opposed plates may pivot toward and away from each other, each plate biased to an inclined position whereat the upper edges of the opposed plates are more proximate than the lower edges of the plates.

According to another aspect of the present invention, there is provided apparatus for fitting a flexible lid to a flexible container, comprising: a pair of opposed plates, each plate pivotably mounted intermediately of its upper and lower edges such that upper edges of said opposed plates may pivot toward and away from each other, each plate biased to an inclined position whereat the upper edges of the opposed plates are more proximate than the lower edges of the plates.

According to a further aspect of the invention, there is provided a method of applying a flexible lid to a flexible container, comprising: placing a lid with respect to a pair of opposed plates, each plate pivotably mounted intermediately of its upper and lower edges such that upper edges of said opposed plates may pivot toward and away from each other, each plate biased to an inclined position whereat the upper edges of the opposed plates are more proximate than the lower edges of the plates such that opposed lower edges of said lid are positioned below said upper edges of said plates and at an outward side of said plates; and raising a container between said plates such that said container urges each of said plates away from its inclined position.

Other features and aspect of the invention will become apparent after review of the following description and drawings.

BRIEF DESCRIPTION OF THE DRAWINGS

In the figures which illustrate an example embodiment of the invention.

DETAILED DESCRIPTION

Figure 1:
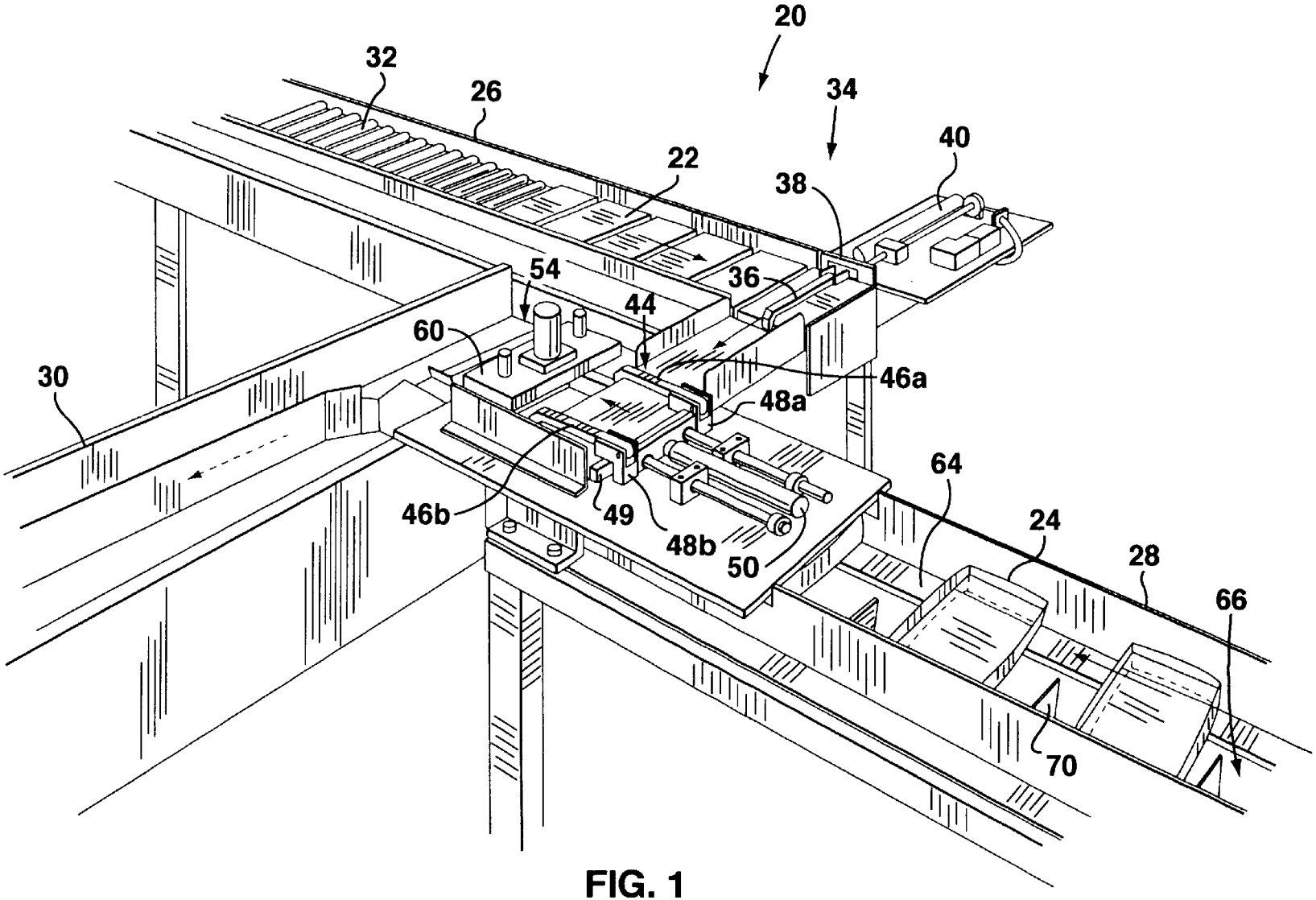
FIG. 1 is a front perspective view of a system made in accordance with this invention.
Figure 2:
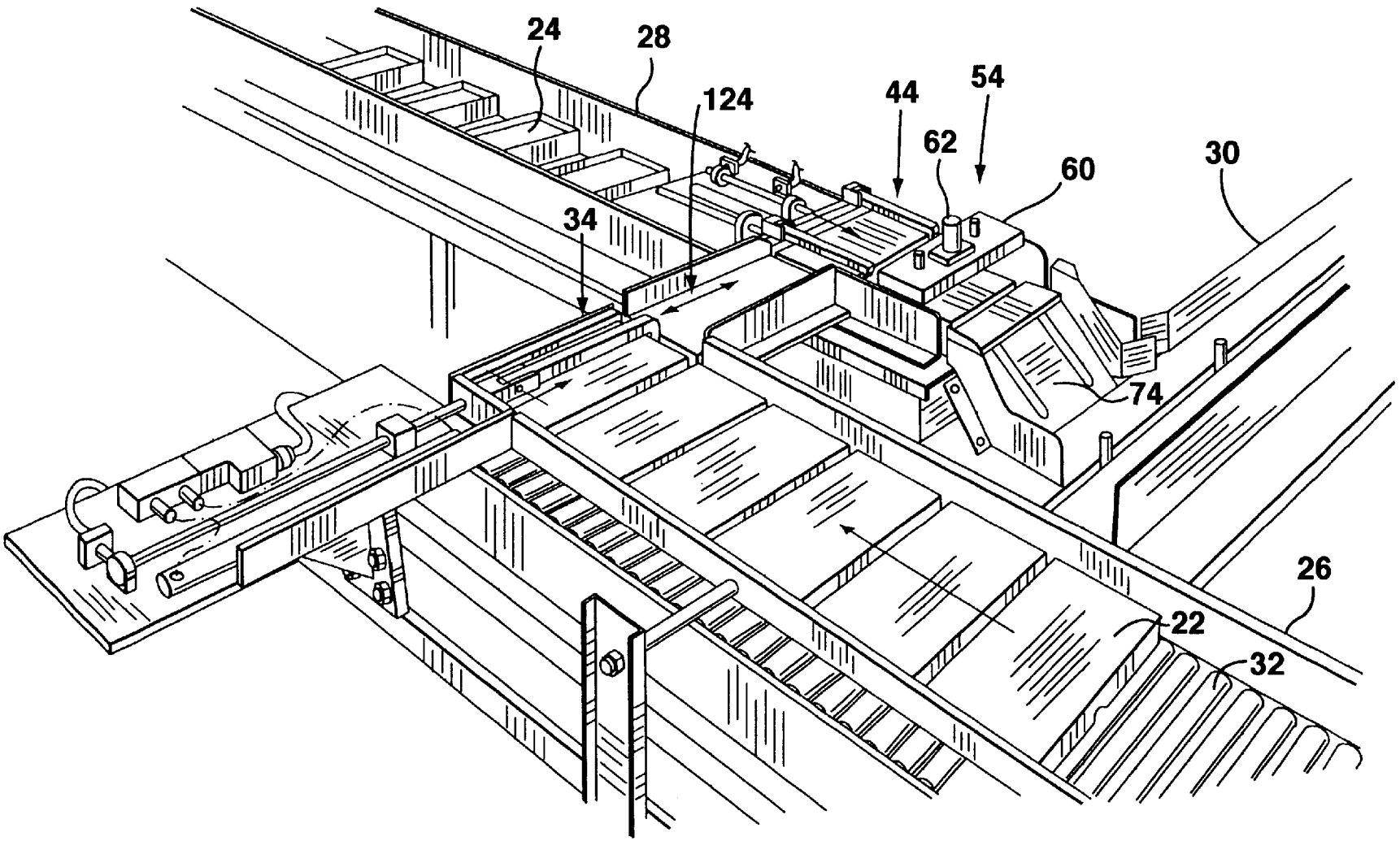
FIG. 2 is a rear perspective view of the system of FIG. 1.

Turning to FIGS. 1 and 2, a system 20 for applying box-lids 22 to box trays 24 comprises a lid conveyor 26, a box tray conveyor 28, and a box conveyor 30.

The lid conveyor 26 may comprise driven rolls 32 which drive lids 22 to a staging station 34. The staging station 34 has a finger 36 pivotably mounted to a base 38 which is driven by an air cylinder 40. Finger 36 with base 40 drive lids to a lid loading station 44.

The lid loading station 44 has a pair of fingers 46*a*, 46*b* each pivotably mounted to a stationary base 48*a*, 48*b*. A loading bar 49 to which a loading platform 51 is joined is driven by an air cylinder 50. Loading bar 49 with loading platform 51 drive lids to a lid applying station 54 and the fingers 46*a*, 46*b* retain the lid at station 54 when the bar 49 with platform. 51 is retracted.

Figure 10:
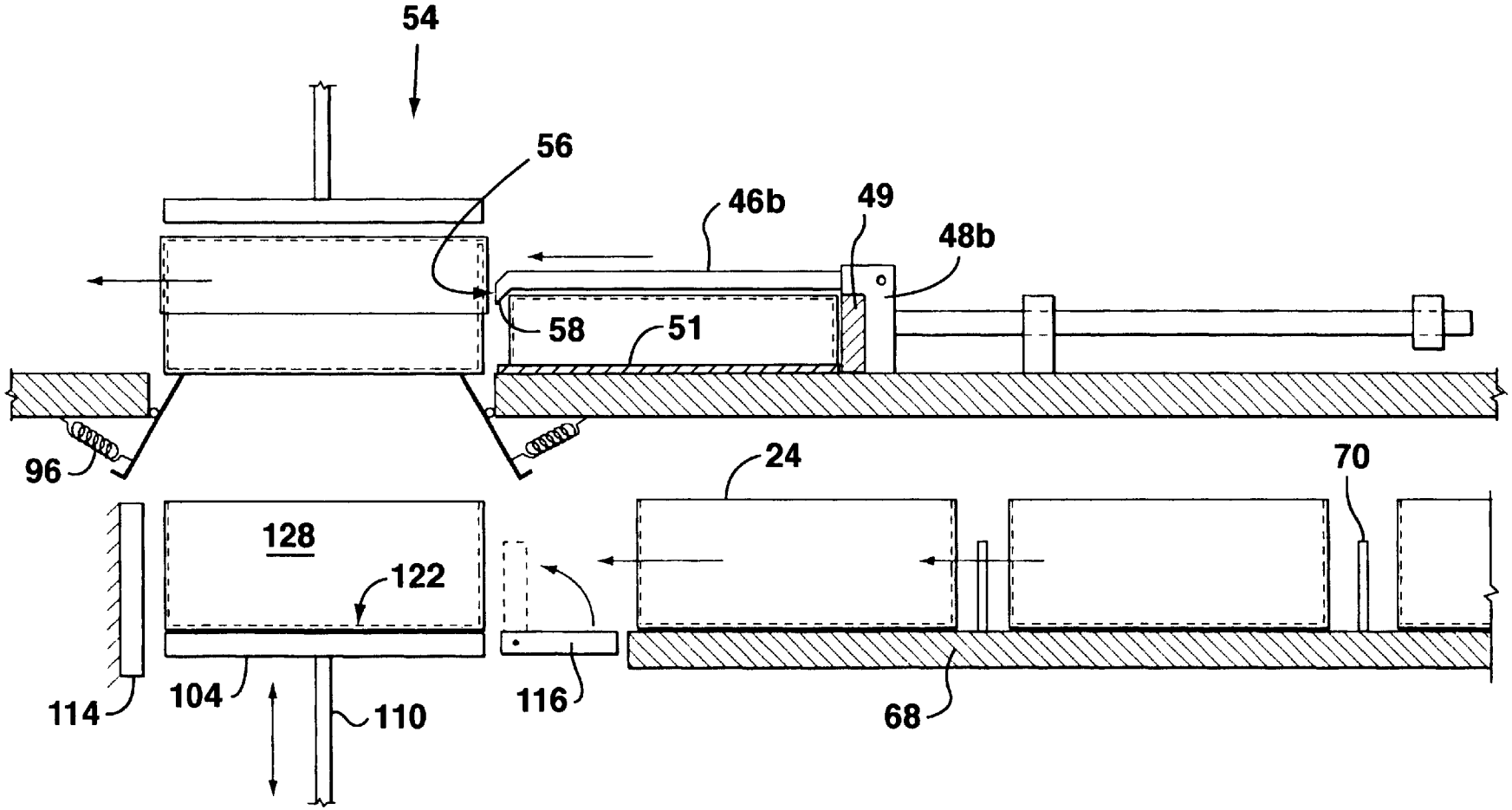

With brief reference to FIG. 10, it will be apparent that each finger has a free, pushing, end 56 from which a cam surface 58 extends at the underside of the finger.

Lid applying station 54 has an overhead lid stop 60 which is driven between a raised position and a lowered, stopping, position by air cylinder 62.

The box tray conveyor 28 may comprise a box tray supporting bed 64 with a central channel 66 receiving a walking beam 68 (FIG. 10) with flights 70. The walking beam walks box trays 24 to lid applying station 54.

An exit chute 74 extends from the lid applying station 54 to box conveyor 30.

Referring to FIGS. 3 to 6, the lid applying station 54 has a pair of opposed side plates 80*a*, 80*b* and a pair of opposed end plates 90*a*, 90*b*. Each plate is pivotably mounted to frame 82 by a hinge pin 84 embedded at either end in the frame 82 such that the hinge pins 84 of each pair of opposed plates 80*a*, 80*b* or 90*a*, 90*b* are parallel. The hinge pins 84 of opposed plates 80*a*, 80*b* are spaced by a distance which is substantially equal to the width of a box tray 24. The hinge pins 84 of opposed plates 90*a*, 90*b* are spaced by a distance which is substantially equal to the length of a box tray 24. Each hinge pin is received through hinge loops 86 which protrude through either face of the plate. The hinge loops are positioned on each plate intermediately of its upper 92 and lower edges 94 such that upper edges of opposed plates may pivot toward and away from each other. Each plate is biased to an inclined position by a light spring 96 so that the upper edges 92 of the opposed plates 80*a*, 80*b* or 90*a*, 90*b* are more proximate than the lower edges 94 of the plates. The limit of the inclined position is set by a foot 98 (FIGS. 4 and 5) of each plate contacting a limit stop, shown in ghost at 99 in FIG. 5. The limit stop may be adjustable to allow setting of the angle of inclination of each plate. For example, the limit stop may comprise an eccentrically mounted cam.

Figure 4:
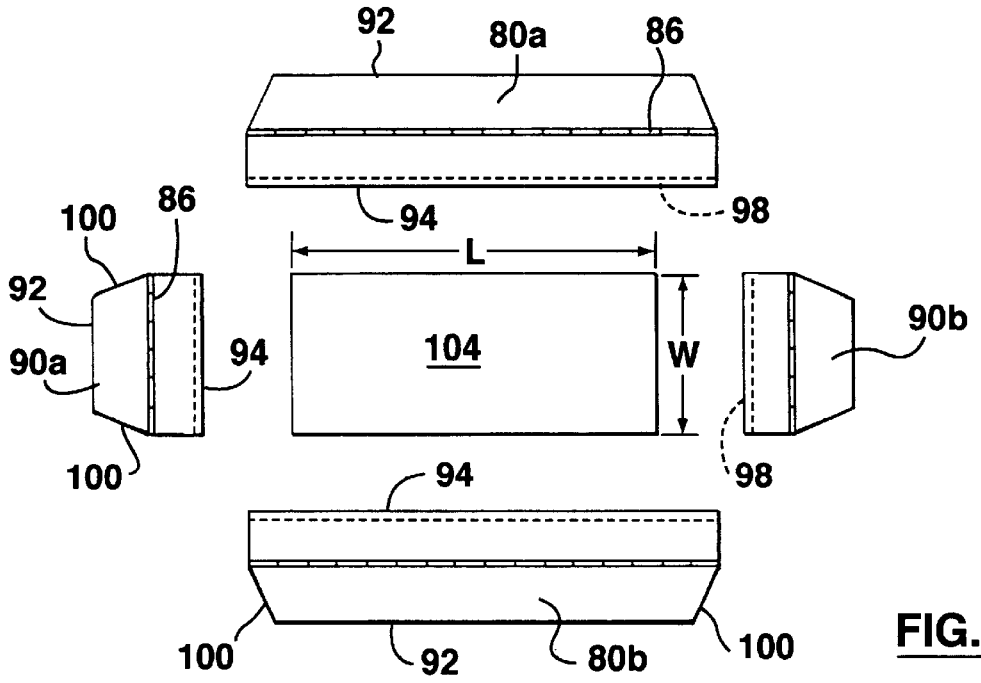
FIG. 4 is a parts view for some of the parts of the lid applying station.

The plates 80*a*, 80*b*, 90*a*, 90*b* are fabricated of a thin sheet steel. The foot 98 which extends rearwardly from the lower edge 94 of each plate stiffens the plate. As best seen in FIG. 4, the upper corners 100 of each plate are chamfered. The chamfered corners 100 allow the upper edges 92 of the four plates to form a generally rectangular outline when opposed plates incline toward each other without adjacent plates interfering.

Figure 5:
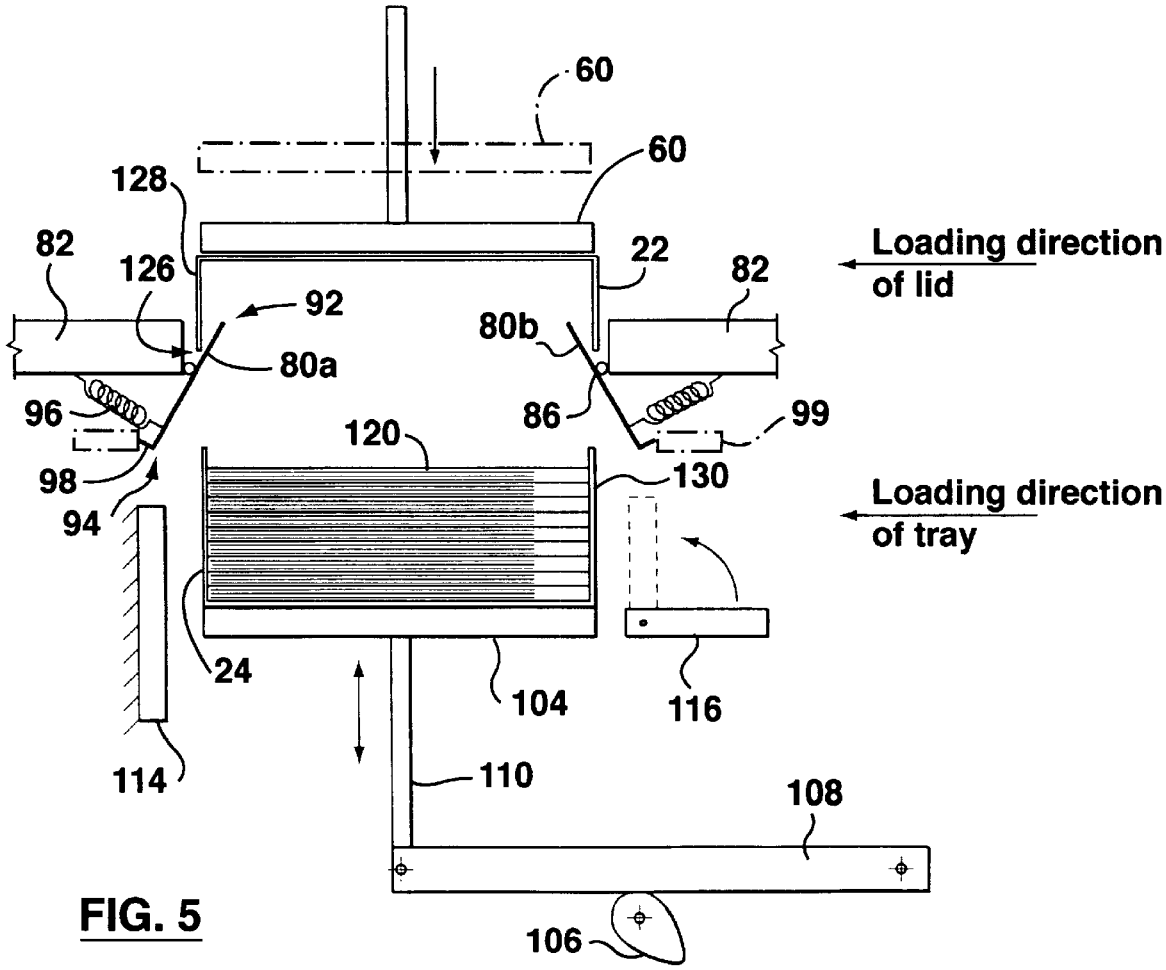
FIGS. 5 to 10 are progressive schematic views of a portion of the system of FIG. 1 in operation.

A box tray support 104 is located directly below the plates 80*a*, 80*b*, 90*a*, 90*b* when in a lowered position (seen in FIG. 10). In this lowered position, the tray support 104 is aligned with the bed 54 of the box tray conveyor 28. With reference to FIG. 5, support 104 may be moved to a raised position between the plates by a cam 106 acting on a lever 108 joined to support 104 through extension 110. The box tray support 104 has a width W which is only slightly less than the distance between the hinge pins 86 of plates 80*a* and 80*b* and a length L which is significantly shorter than the distance between the hinge pins 86 of plates 90*a* and 90*b*.

A fixed abutment wall 114 extends beside box tray support 104 below plate 80*a* and a flip up wall 116 extends beside the opposite side of support 104 below plate 80*b*.

Figure 3:
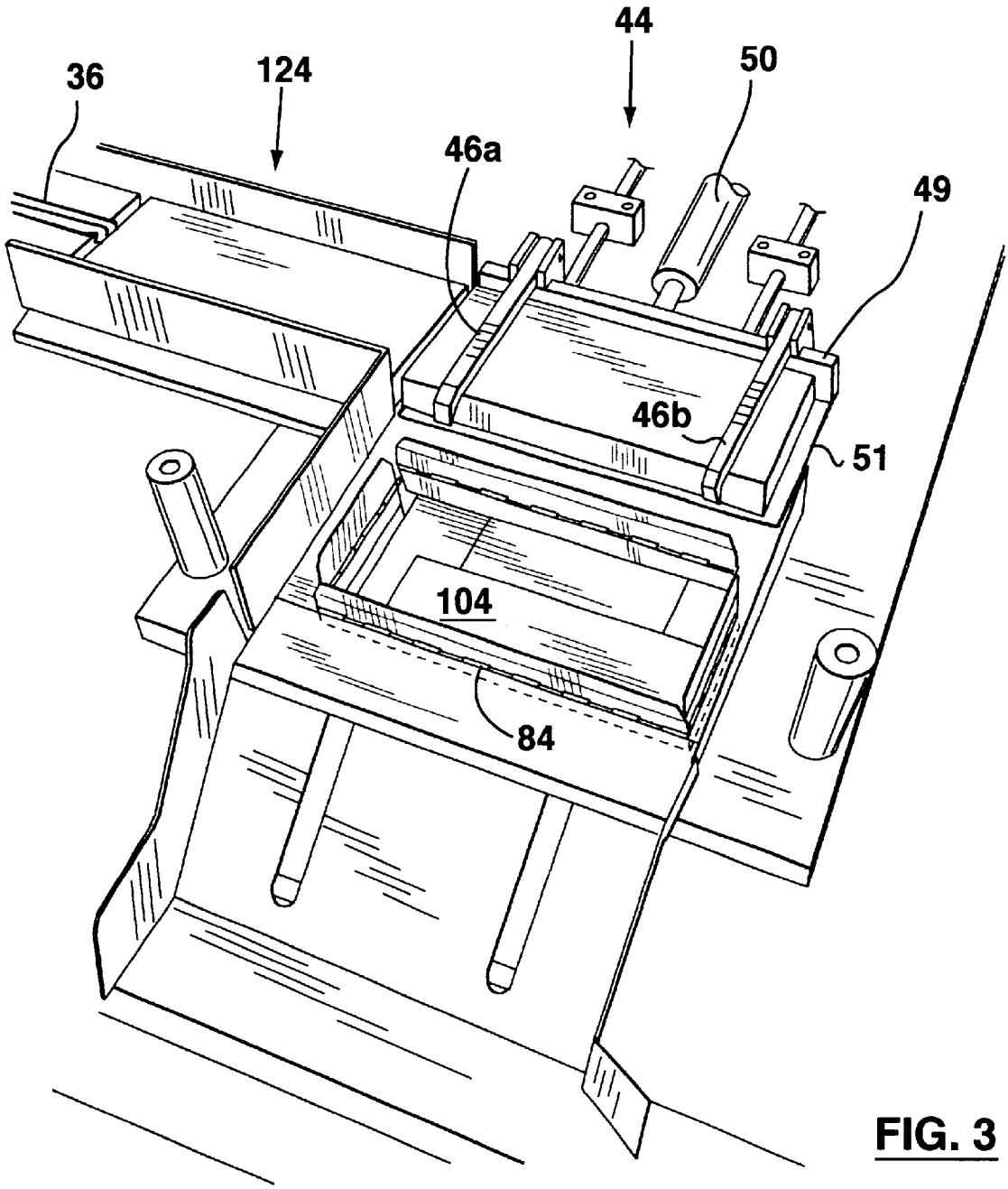
FIG. 3 is a top perspective view of the lid applying station of the system of FIG. 1 absent the lid stop.

In operation, lids 22 are loaded to lid conveyor 26 such that they open downwardly. The lid conveyor 26 then drives lids to staging station 34. Air cylinder 40 initially maintains finger 36 in a retracted position illustrated in FIGS. 1 and 2. As such, the lid conveyor 26 conveys a lid 22 under the finger 36. Air cylinder 40 may then extend such that base 38 pushes the lid 22 which is under the finger along to an intermediate station 124. The finger itself assists in ensuring the lid thereunder has a controlled motion. Once the air cylinder 40 has reached the end of its extension stroke it retracts again. As finger 36 is retracted, cam surface 58 of the finger rides onto the lid and the finger pivots in consequence. As the air cylinder completes its retraction stroke, the cam surface 58 of the finger reaches the upstream end of the lid and the pushing end 56 of the finger 36 drops in behind the lid. Another lid may then be conveyed under finger 36. Now, when air cylinder 40 again moves to its extended position, the lid at the intermediate station 124 is pushed by the pushing end 56 of the finger 36 to the lid loading station 44 while the lid under the finger is moved to the intermediate station 124. FIG. 3 illustrates lids 22 of system 20 at the intermediate 124 and loading 44 stations. From FIG. 3, it will be apparent that a lid at the lid loading station 44 is positioned on platform 51 and under fingers 46*a*, 46*b*. With a lid in this position, air cylinder 50 may be extended to an extended position. As the air cylinder extends, the lid is carried to the lid applying station 54 by bar 49 and platform 51. As this occurs, the leading edge of the lid pushes against the cam surface 58 (FIG. 10) of the fingers 46*a*, 46*b* causing the fingers to pivot within their respective bases 48*a*, 48*b* as the cam surface 58 rides up onto the lid. When the lid reaches the lid applying station 54, the pushing ends 56 of the fingers drop in behind the lid. With the lid on the platform 51 at the lid applying station, the lid is positioned above plates 80*a*, 80*b*, 90*a*, 90*b* and centered with respect to the plates. Next, the air cylinder 50 retracts to pull bar 49 and platform 51 back. However, the pushing ends 56 of the fingers 46*a*, 46*b* restrain the lid from retracting with the platform and therefore act to strip the lid from the platform so that the lid drops down onto plates 80*a*, 80*b*, 90*a*, 90*b*. Because the spacing of the hinge pins 84 matches the width and length of each tray 24, with the plates in their inclined resting positions, the upper edges 92 of opposed plates will be spaced at a distance less than the distance between opposed sidewalls 128 of the lid. Consequently, a lid centered over the plates at the lid applying station will drop down so that the lower edge 126 of each lid sidewall 128 is positioned below the upper edges 92 of the plates and the lid sidewalls are at an outward side of the plates.

While a lid is being moved to the lid applying station 54, a box tray 24 is also being moved to this station. Thus, box trays 24, filled with their contents (which, as illustrated in FIG. 5, may be bundles 120 of cheques) are loaded onto box tray conveyor 28. A walking beam 68, operating in a conventional fashion, may then be moved along an oval path to incrementally advance box trays to the lid applying station 54. Box tray support 104 is in its lowered position (illustrated in FIGS. 5 and 10) registered with bed 54 of conveyor 28 when the walking beam 68 moves a box tray 24 to the lid applying station 54. In consequence, the tray is moved onto the tray supporting surface 122 of the tray support 104 as shown in FIG. 5. After a box tray reaches the lid applying station 54, the flip up wall 116 is flipped up.

Figure 6:
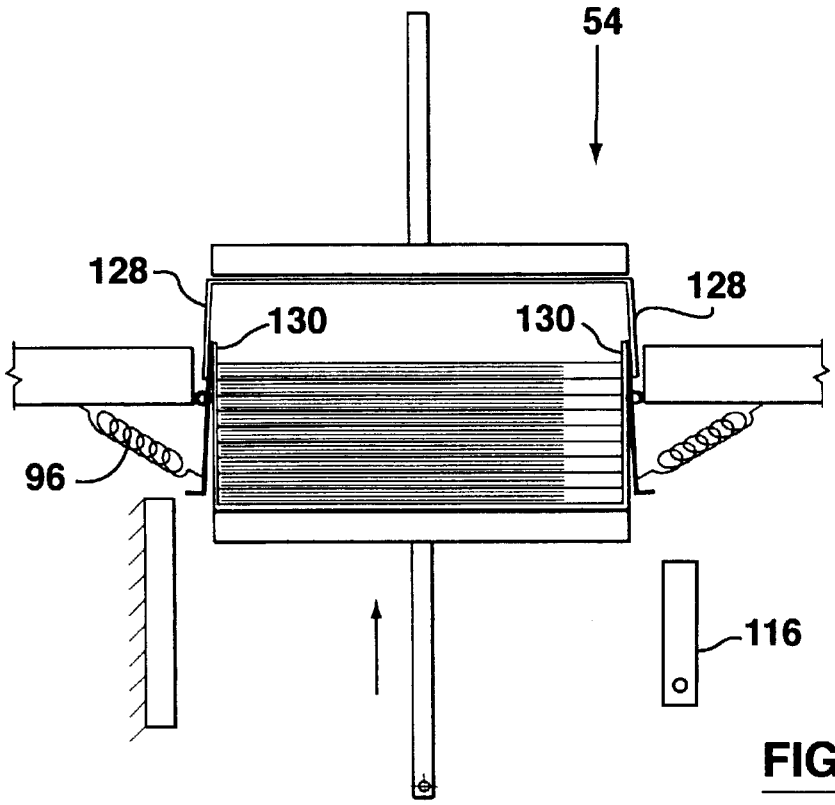

With both a tray 24 and lid 22 at the lid applying station, overhead lid stop 60 is lowered from its raised position shown in ghost in FIG. 5 to its position shown in solid line in FIG. 5. Cam 106 is rotated to raise the tray support 104. This moves tray 24 between the plates 80*a*, 80*b* and 90*a*, 90*b* so that the tray contacts each plate between its intermediate hinge loops 86 and its upper edge 92 as seen in FIG. 6. In this position the sidewalls of the tray apply a force to each plate in opposition to light spring 96 causing the plates to pivot away from their inclined positions toward the vertical, also as seen in FIG. 6. The reaction force applied by the plates on the sidewalls 130 of the tray 24 urge these tray sidewalls 130 to incline inwardly.

The urging of the plates toward the vertical also tends to expand the sidewalls of lid 22, urging these lid sidewalls 128 to incline outwardly. Thus, the plates act to control the shape of the lid and tray to avoid bowing, etc., which could interfere with the fitting of the lid to the box tray.

As the tray 24 continues to be raised, the upper margin of the sidewalls 130 of the tray is overlapped by the lower margin of sidewalls 128 of lid 22. This results by virtue of the fact that the sidewalls of the tray are between the plates whereas the sidewalls of the lid are on the outside of the plates.

Figure 7:
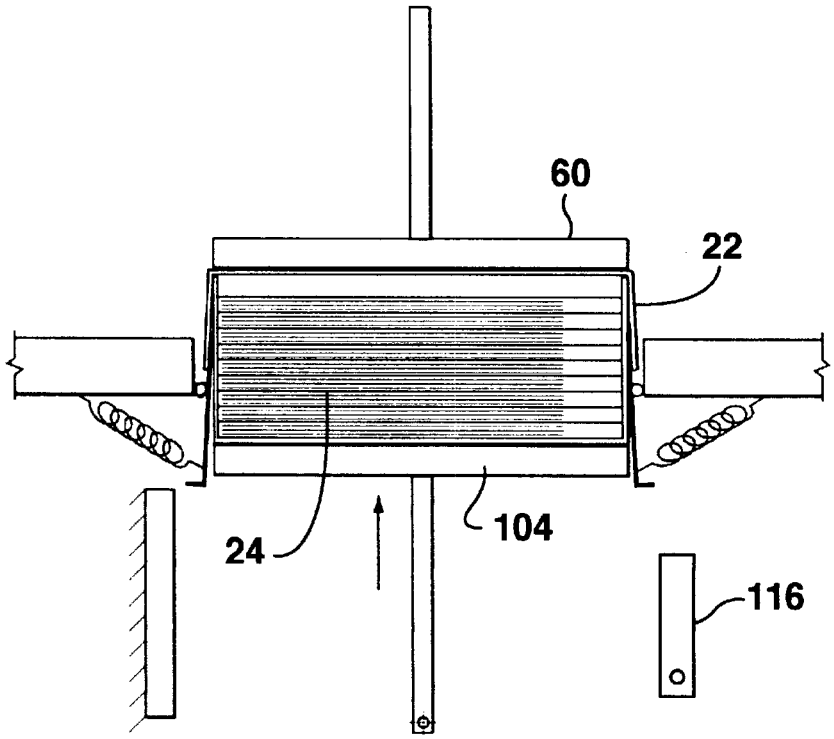
Figure 8:
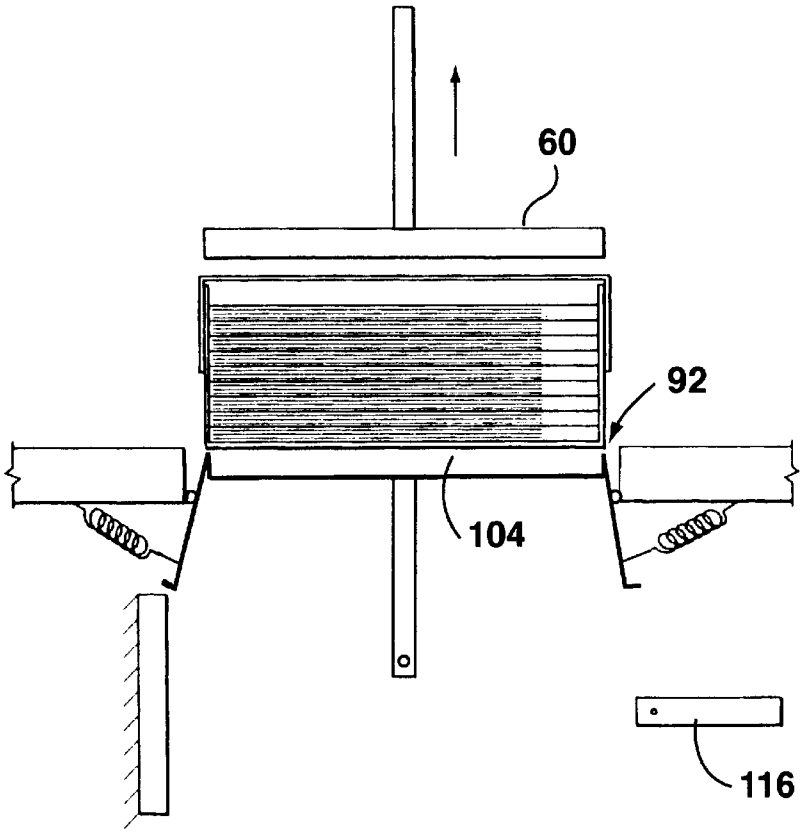

Once tray support 104 has been raised sufficiently to fully seat the lid 22 on the tray 24 as seen in FIG. 7, the overhead lid stop 60 is returned to its raised position. The tray support is raised still further until the tray is raised to a raised position which is at or above the upper edges 92 of the plates, as seen in FIG. 8. When the bottom of the tray reaches the upper edges 92 of the plates, plates 90*a* and 90*b* snap back toward their resting inclined position. This is due to the fact that the length L (FIG. 4) of the tray support is significantly less than the distance between the hinge pins 86 of plates 90*a*, 90*b*. Conversely, plates 80*a* and 80*b* move little or not at all when the bottom of the tray reaches the upper edges 92 of the plates due to the fact that the width W (FIG. 4) of the tray support 104 is only slightly less than the distance between the hinge pins of plates 80*a*, 80*b*.

Figure 9:
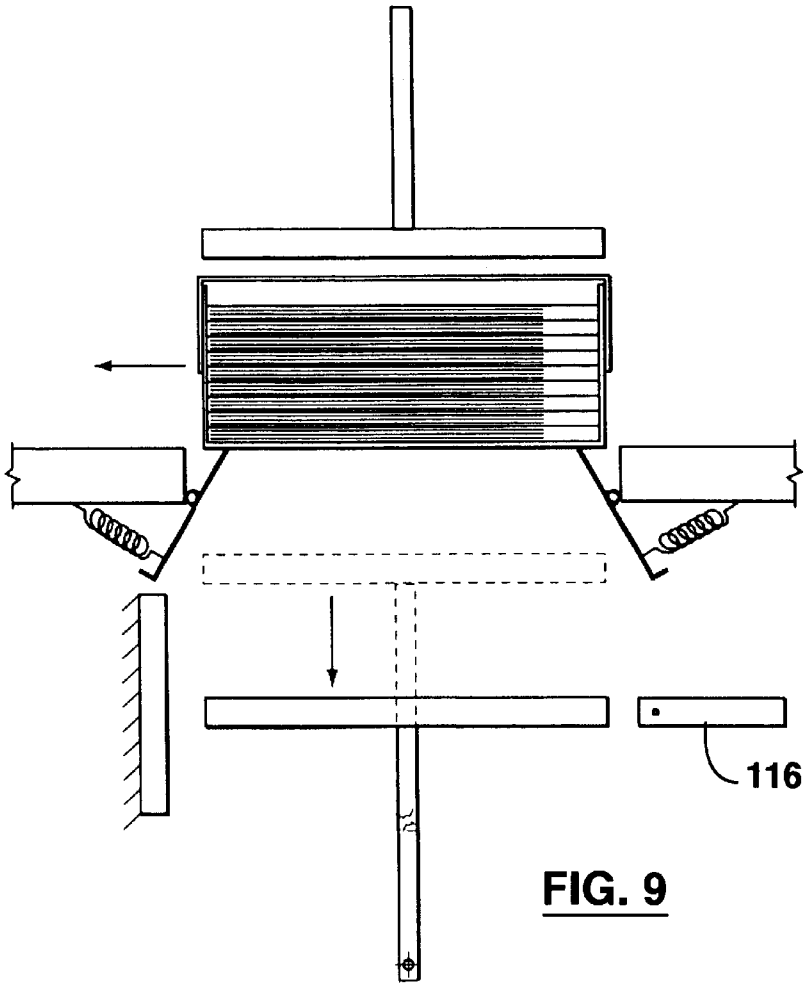

When plates 90*a*, 90*b* snap back to their inclined resting position, they are positioned directly under tray 24. Consequently, when the tray support is lowered from its fully raised position, the tray 24 (with the lid 22 which has been fitted thereto) remains atop the plates 80*a*, 80*b*, 90*a*, 90*b*, as illustrated in FIG. 9. Also, as seen in FIG. 9, as the tray support 104 is lowered, the plates 80*a*, 80*b* are allowed by the support 104 to return to their resting inclined position.

At some point during the lowering of tray support 104, flip wall 116 is dropped so that when the tray support reaches its lowered position another tray 24 may be moved onto the tray support, as shown in FIG. 10. Additionally, air cylinder 50 is activated so that the bar 49 and platform 51 convey another lid to the lid applying station 54. In so doing, the conveyed lid pushes the completed box (i.e., the box tray with fitted lid) from the lid applying station 54 to the exit chute 74 (FIG. 2). With a new lid at the above the plates at the lid applying station 54, the process of fitting a lid to a tray may repeat.

The operation of the various components may be electrically or mechanically synchronized in any suitable fashion.

Tray conveyor 28 with walking beam 68 may be replaced by any other conveyor which will place a tray on tray support 104, such as a belt or chain conveyor which is moved in a step-wise fashion by, for example, a stepper motor or servo motor. Similarly, lid conveyor 26 and the apparatus at staging station 34 and lid loading station 44 may be replaced by any other conveyor or conveyor combination which will place lids serially at lid applying station 54. Thus, for example, if overhead lid stop 60 is modified to pivot toward and away from the lid applying station 54, then with the overhead lid stop pivoted out of the way, lids may be lowered in step-wise fashion onto the lid loading station. This may be accomplished by, for example, a pair of opposed conveyors with lid supporting fingers which separate at the lid loading station.

Fixed wall 114 and flip up wall 116 assist in confining a tray 24 and preventing buckling of its sidewalls 130 as these sidewalls force against the plates 80*a*, 80*b*, 90*a*, 90*b*. However, where the tray is fabricated of sufficiently stiff materials, these walls may be omitted.

While it is preferred to raise tray support 104 until plates 90*a*, 90*b* snap back to their inclined rest position under a completed box so as to facilitate removing the completed box from the lid applying station 54, this is not necessary. Instead, the tray support need only be raised until the lid is suitably fitted to the box tray and then the completed box may be removed from the lid applying station 54 in any suitable fashion. For example, a pair of grip fingers could grab the completed box and pull it from the lid applying station. This would require that the overhead lid stop 60 pivot away from the lid applying station to an inactive position which would not interfere with such grip fingers.

Although each plate is shown as pivoting about a hinge pin equidistant from its upper and lower edges, this is not necessary. A plate may pivot about a hinge pin positioned anywhere intermediate of its upper and lower edges which allows the described operation.

System 20 may be used with box trays of greater or lesser height than box tray 24 provided the box tray clears the plates 80*a*, 80*b*, 90*a*, 90*b* when moved onto tray support 104. To adapt system 20 to fit different sized lids to different sized box trays, the set of plates 80*a*, 80*b*, 90*a*, 90*b* may be replaced with an appropriately different sized set and the spacing of the hinge pins chosen so as to mirror the dimensions of the box tray.

While system 20 has been described in conjunction with fitting rectangular lids to rectangular box trays, it could also be adapted to fit lids of non-rectangular boxes with an appropriate configuration of an appropriate set of plates and hinge pins.

The lids 22 and trays 24 are typically fabricated of card stock or box board. However, system 20 can also operate with lids and trays fabricated of other flexible materials, such as plastic.

While box trays have been illustrated as containing bundles of cheques, the box trays could contain equally contain anything desired, such as greeting cards or chocolates.

Other modifications will be apparent to those skilled in the art and, therefore, the invention is defined in the claims.

What is claimed is:

1. A box-lid applicator, comprising:

a pair of opposed plates, each plate pivotably mounted intermediately of its upper and lower edges such that upper edges of said opposed plates may pivot toward and away from each other, each plate biased to an inclined position whereat the upper edges of the opposed plates are more proximate than the lower edges of the plates;

a raisable box tray support having a lowered position below said plates and a raised position between said plates such tat a box tray supporting surface of said box way support is at or above said upper edges; and a lid stop above said plates.

2. The lid applicator of claim 1 wherein said plates are pivotably mounted by parallel pivots.

3. The lid applicator of claim 1 further comprising an adjustable limit stop for setting said inclined position.

4. The lid applicator of claim 1 wherein said plates are spring biased.

5. The lid applicator of claim 1 wherein said box tray support has a lateral extent greater than a distance between said upper edges of said plates when in said inclined position such that when said box tray support is moved to said raised position, said plates are moved away front said inclined position.

6. The lid applicator of claim 5 wherein said lid stop has a raised position and a lowered, stopping, position.

7. The lid applicator of claim 5 wherein said pair of opposed plates comprises a pair of opposed side plates and further comprising a pair of opposed end plates each pivotably mounted intermediately of its upper and lower edges and biased to an inclined position whereat the upper edges of the end plates are more proximate than the lower edges of the end plates.

8. The lid applicator of claim 7 wherein said upper edges of said side plates and end plates form a generally rectangular outline.

9. The lid applicator of claim 7 wherein upper comers of each of said plates are chamfered.

10. The lid applicator of claim 1 further comprising a lid loader arranged for loading a lid such that lower edges of opposed sides of said lid are positioned below said upper edges of said plates and at an outward side of said plates.

11. The lid applicator of claim 10 further comprising walls for confining a box tray raised by said raisable box tray support to ensure said box tray moves upwardly between said plates and does not buckle.

12. The lid applicator of claim 11 wherein said walls comprise a fixed wall and an opposed moveable wall having a box tray loading position permitting loading of a box tray onto said raisable box tray support and a supporting position for said confining.

13. A method of applying a flexible lid to a flexible container, comprising:

placing a lid with respect to a pair of opposed plates, each plate pivotably mounted intermediately of its upper and lower edges such that upper edges of said opposed plates may pivot toward and away from each other, each plate biased to an inclined position whereat the upper edges of the opposed plates are more proximate tan the lower edges of the plates such that opposed lower edges of said lid are positioned below said upper edges of said plates and at an outward side of said plates;

raising a container between said plates such that said container urges each of said plates away from its inclined position;

continuing to raise said container between said plates until said container is raised to a raised position which is at or above said upper edges of said plates; and stopping said lid with means for stopping said lid while said container is raised to said raised position such that said container pushes into said lid and said lid is fitted onto said container as said container is raised toward said raised position.

* * * * *